US005888154A

United States Patent [19]

Hartman

[11] Patent Number: 5,888,154

[45] Date of Patent: Mar. 30, 1999

[54] RESISTANCE DEVICE FOR A BASEBALL BAT

[76] Inventor: Brian T. Hartman, Storgt-15, 1440 Drobak, Norway

[21] Appl. No.: 65,841

[22] Filed: Apr. 24, 1998

[51] Int. Cl.[6] ..... A63B 69/00

[52] U.S. Cl. ..... 473/457

[58] Field of Search ..... 473/437, 457

[56] References Cited

U.S. PATENT DOCUMENTS

| | | | |
|---|---|---|---|
| 3,206,195 | 9/1965 | Myers | 473/457 |
| 3,268,225 | 8/1966 | Martino | 473/457 |
| 3,623,724 | 11/1971 | Lande | 473/437 |
| 3,971,559 | 7/1976 | Diforte, Jr. | 473/437 |
| 4,416,451 | 11/1983 | Solloway | 473/457 |
| 4,907,800 | 3/1990 | Passananeck | 473/457 |
| 5,002,275 | 3/1991 | Beutler | 473/457 |
| 5,024,436 | 6/1991 | Vento | 473/437 |
| 5,050,877 | 9/1991 | Wales | 473/437 |
| 5,165,683 | 11/1992 | Beutler | 473/457 |
| 5,186,699 | 2/1993 | Dimnig | 473/437 |
| 5,395,107 | 3/1995 | Pippo | 473/437 |
| 5,803,838 | 9/1998 | DeMarini | 473/457 |

*Primary Examiner*—Theatrice Brown

[57] ABSTRACT

A resistance device for a baseball bat including a cylindrical sleeve dimensioned for receiving a barrel of a baseball bat therein. The cylindrical sleeve has an open lower end for receiving the barrel therein. A chute portion is provided that is comprised of an essentially planar and flexible rectangular sheet. The sheet has a plurality of straps extending outwardly from opposing long side edges thereof for adjustable securement to the cylindrical sleeve.

5 Claims, 2 Drawing Sheets

WITH CHUTE ATTACHED AND OPEN:

WITH CHUTE NOT ATTACHED AND USING SLEEVE AS PROTECTIVE COVER.

WITH CHUTE ATTACHED AND OPEN.

RESISTANCE DEVICE FOR A BASEBALL BAT

BACKGROUND OF THE INVENTION

1. Field of the Invention

The present invention relates to a resistance device for a baseball bat and more particularly pertains to creating resistance when swinging a baseball bat with a resistance device for a baseball bat.

2. Description of the Prior Art

The use of baseball practice device is known in the prior art. More specifically, baseball practice device heretofore devised and utilized for the purpose of improving baseball playing abilities are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,207,625 to White; U.S. Pat. No. 5,395,107 to De Pippo; U.S. Pat. No. 4,330,121 to McCafferty; U.S. Pat. No. 4,907,800 to Passamaneck et al.; U.S. Pat. No. 5,058,890 to Szabo; and U.S. Pat. No. 3,268,226 to Martino.

While these devices fulfill their respective, particular objective and requirements, the aforementioned patents do not describe a resistance device for a baseball bat for creating resistance when swinging a baseball bat.

In this respect, the resistance device for a baseball bat according to the present invention substantially departs from the conventional concepts and designs of the prior art, and in doing so provides an apparatus primarily developed for the purpose of creating resistance when swinging a baseball bat.

Therefore, it can be appreciated that there exists a continuing need for new and improved resistance device for a baseball bat which can be used for creating resistance when swinging a baseball bat. In this regard, the present invention substantially fulfills this need.

SUMMARY OF THE INVENTION

In the view of the foregoing disadvantages inherent in the known types of baseball practice device now present in the prior art, the present invention provides an improved resistance device for a baseball bat. As such, the general purpose of the present invention, which will be described subsequently in greater detail, is to provide a new and improved resistance device for a baseball bat and method which has all the advantages of the prior art and none of the disadvantages.

To attain this, the present invention essentially comprises a cylindrical sleeve dimensioned for receiving a barrel of a baseball bat therein. The cylindrical sleeve has an open lower end for receiving the barrel therein. The open lower end has an adjustable strap extending therearound to facilitate securement of the cylindrical sleeve to the baseball bat. The cylindrical sleeve has a plurality of hook and loop strips transversing thereon in a spaced relationship. The cylindrical sleeve has a handle secured to a central portion thereof. A chute portion is provided and is comprised of an essentially planar and flexible rectangular sheet. The sheet has a plurality of straps extending outwardly from opposing long side edges thereof. The straps of a first side edge of the sheet have free ends secured to the cylindrical sleeve at a position opposite from the hook and loop strips. The straps of a second side edge of the sheet have free ends with hook and loop strips extending a length thereof for adjustably coupling with the hook and loop strips of the cylindrical sleeve.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved resistance device for a baseball bat which has all the advantages of the prior art baseball practice device and none of the disadvantages.

It is another object of the present invention to provide a new and improved resistance device for a baseball bat which may be easily and efficiently manufactured and marketed.

It is a further object of the present invention to provide a new and improved resistance device for a baseball bat which is of durable and reliable construction.

An even further object of the present invention is to provide a new and improved resistance device for a baseball bat which is susceptible of a low cost of manufacture with regard to both materials and labor, and which accordingly is then susceptible of low prices of sale to the consuming public, thereby making such a resistance device for a baseball bat economically available to the buying public.

Even still another object of the present invention is to provide a new and improved resistance device for a baseball bat for creating resistance when swinging a baseball bat.

Lastly, it is an object of the present invention to provide a new and improved resistance device for a baseball bat including a cylindrical sleeve dimensioned for receiving a barrel of as baseball bat therein. The cylindrical sleeve has an open lower end for receiving the barrel therein. A chute portion is provided that is comprised of an essentially planar and flexible rectangular sheet. The sheet has a plurality of straps extending outwardly from op posing long side edges thereof for adjustable securement to the cylindrical sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
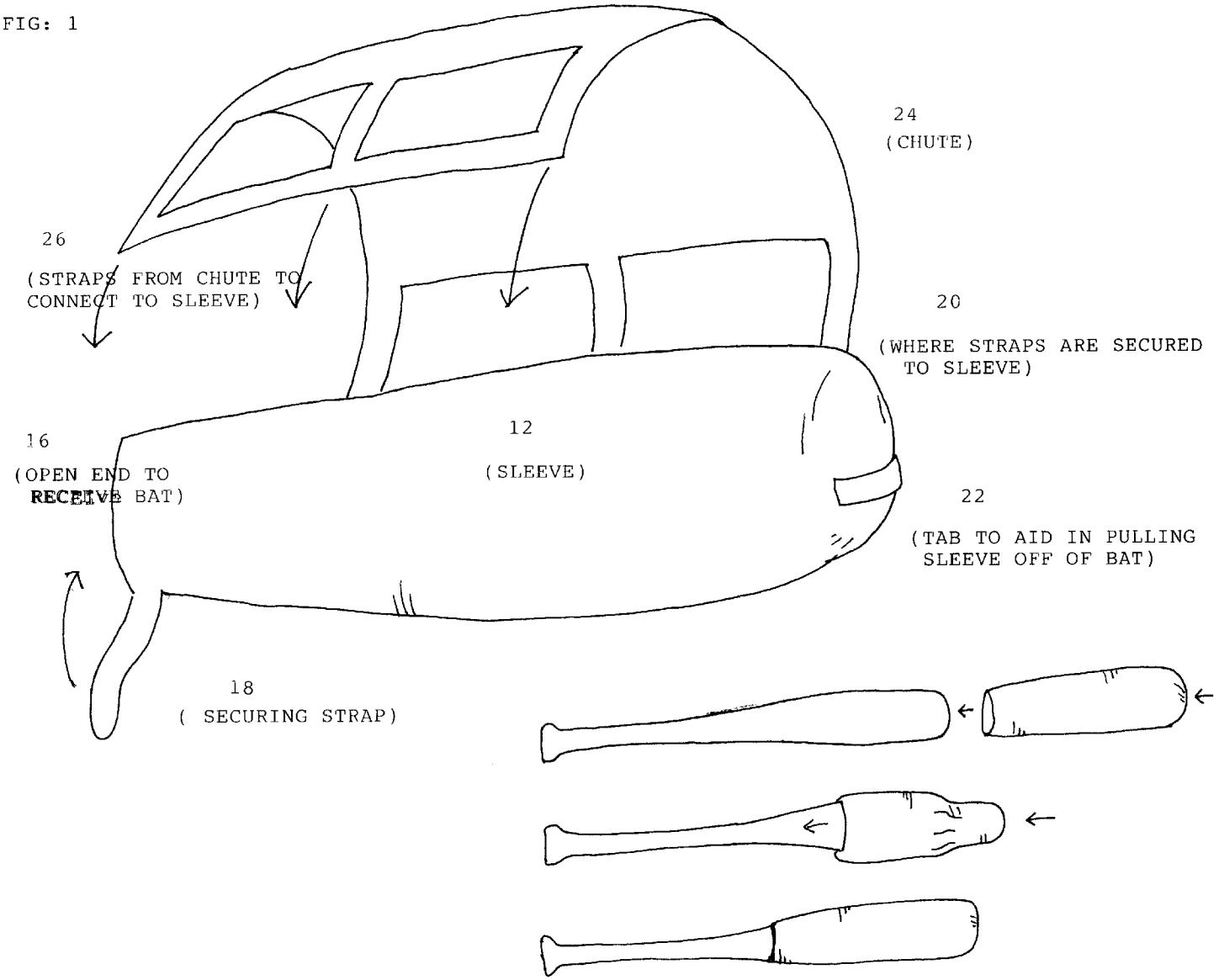
FIG. 1 is a perspective view of the preferred embodiment of the resistance device for a baseball bat constructed in accordance with the principles of the present invention.
Figure 2:
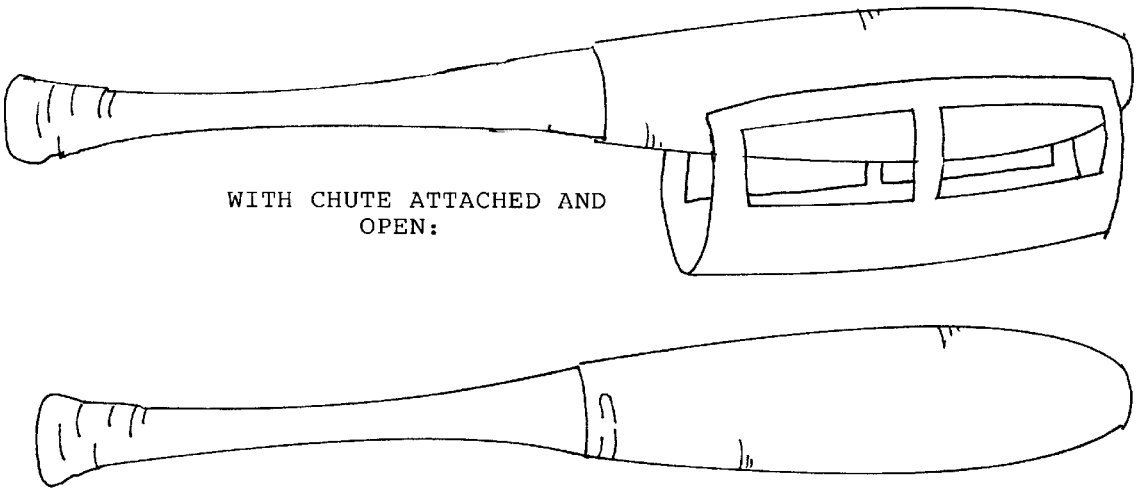
FIG. 2 is a side view of the present invention illustrated secured to a baseball bat.
Figure 3:
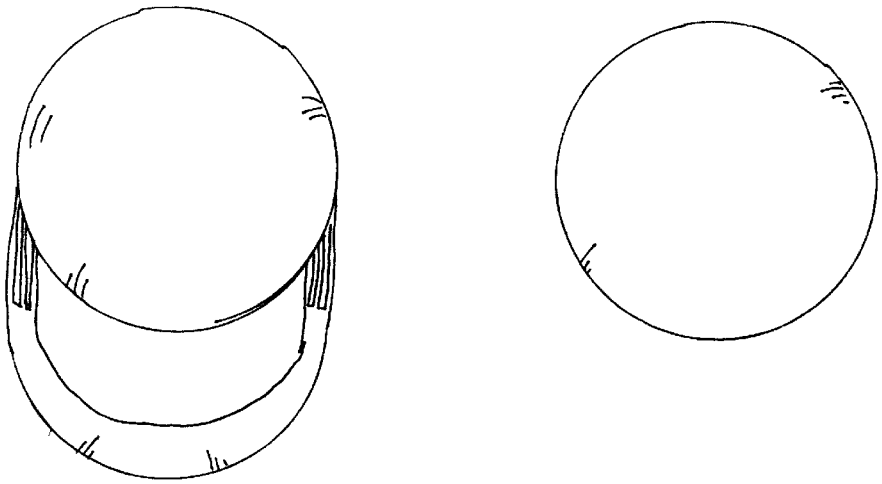
FIG. 3 is cross-sectional view of the present invention as taken along line 3—3 of FIG. 2.

With reference now to the drawings, and in particular, to FIGS. 1 through 3 thereof, the preferred embodiment of the new and improved resistance device for a baseball bat embodying the principles and concepts of the present invention and generally designated by the reference number 10 will be described.

Specifically, it will be noted in the various Figures that the device relates to a resistance device for a baseball bat for creating resistance when swinging a baseball bat. In its broadest context, the device consists of a cylindrical sleeve and a chute portion. Such components are individually configured and correlated with respect to each other so as to attain the desired objective.

The cylindrical sleeve 12 is dimensioned for receiving a barrel of a baseball bat 14 therein. The cylindrical sleeve 12 has an open lower end 16 for receiving the barrel therein. The open lower end 16 has an adjustable strap 18 extending therearound to facilitate securement of the cylindrical sleeve 12 to the baseball bat 14. The adjustable strap includes hook and loop fasteners thereon to mate with a hook and loop strap disposed on the lower end of the cylindrical sleeve 12. The cylindrical sleeve 12 has a plurality of hook and loop strips 20 transversing thereon in a spaced relationship. The cylindrical sleeve 12 has a handle 22 secured to a central portion thereof. The cylindrical sleeve 12 is designed to fit all sizes of baseball and softball bats.

The chute portion 24 is comprised of an essentially planar and flexible rectangular sheet. The sheet has a plurality of straps 26 extending outwardly from opposing long side edges thereof. The straps 26 of a first side edge of the sheet have free ends secured to the cylindrical sleeve 12 at a position opposite from the hook and loop strips 20. The straps 26 of a second side edge of the sheet have free ends with hook and loop strips extending a length thereof for adjustably coupling with the hook and loop strips 20 of the cylindrical sleeve 12. The chute portion 24 could be removed from the cylindrical sleeve 12 after excessive use thereby requiring a new chute portion.

In use, the chute portion 24, when secured to the cylindrical sleeve 12, will hang downwardly from the baseball bat 14. Note FIGS. 2 and 3. The chute portion 24 will provide resistance for when the bat 14 is swung by the user. The length the chute portion 24 is suspended from the cylindrical sleeve cab be adjusted whereby the more the chute portion 24 is away from the baseball bat 14, the more resistance will be felt when the bat 14 is swung. The present invention also acts as a covering device for the baseball bat. Optionally, weights or weighted material could be added to the present invention to provide additional resistance. A small gauge could also be attached to the present invention to measure the power and speed of the user's swing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A resistance device for a baseball bat for creating resistance when swinging a baseball bat comprising, in combination:

a cylindrical sleeve dimensioned for receiving a barrel of as baseball bat therein, the cylindrical sleeve having an open lower end for receiving the barrel therein, the open lower end having an adjustable strap extending therearound to facilitate securement of the cylindrical sleeve to the baseball bat, the cylindrical sleeve having a plurality of hook and loop strips transversing thereon in a spaced relationship, the cylindrical sleeve having a handle secured to a central portion thereof;

a chute portion comprised of an essentially planar and flexible rectangular sheet, the sheet having a plurality of straps extending outwardly from opposing long side edges thereof, the straps of a first side edge of the sheet having free ends secured to the cylindrical sleeve at a position opposite from the hook and loop strips, the straps of a second side edge of the sheet having free ends with hook and loop strips extending a length thereof for adjustably coupling with the hook and loop strips of the cylindrical sleeve.

2. A resistance device for a baseball bat for creating resistance when swinging a baseball bat comprising, in combination:

a cylindrical sleeve dimensioned for receiving a barrel of as baseball bat therein, the cylindrical sleeve having an open lower end for receiving the barrel therein;

a chute portion comprised of an essentially planar and flexible rectangular sheet, the sheet having a plurality of straps extending outwardly from opposing long side edges thereof for adjustable securement to the cylindrical sleeve.

3. The resistance device for a baseball bat as set forth in claim 2 wherein the open lower end of the cylindrical sleeve has an adjustable strap extending therearound to facilitate securement of the cylindrical sleeve to the baseball bat.

4. The resistance device for a baseball bat as set forth in claim 2 wherein the cylindrical sleeve has a handle secured to a central portion thereof.

5. The resistance device for a baseball bat as set forth in claim 2 wherein the straps of a first side edge of the sheet have free ends secured to the cylindrical sleeve at a position opposite from a plurality of hook and loop strips disposed thereon, the straps of a second side edge of the sheet having free ends with hook and loop strips extending a length thereof for adjustably coupling with the hook and loop strips of the cylindrical sleeve.

* * * * *